US005790912A

United States Patent [19]

Myers

[11] Patent Number: 5,790,912

[45] Date of Patent: Aug. 4, 1998

[54] LIGHT SENSITIVE LEADER CLOSURE FOR ROLL FILM

[75] Inventor: Keith Myers, Rochester, N.Y.

[73] Assignee: Eastman Kodak Company, Rochester, N.Y.

[21] Appl. No.: 876,039

[22] Filed: Jun. 13, 1997

[51] Int. Cl.[6] ..... G03C 3/02

[52] U.S. Cl. ..... 396/511; 430/501; 206/813; 206/389

[58] Field of Search ..... 430/501; 206/389, 206/813; 242/582, 583; 396/512, 647, 511; 352/235

[56] References Cited

U.S. PATENT DOCUMENTS

| | | | |
|---|---|---|---|
| 709,053 | 9/1902 | Shaw | 430/501 |
| 1,170,674 | 2/1916 | Robertson | 430/501 |
| 1,180,415 | 4/1916 | Nasief et al. | 430/501 |
| 1,251,766 | 1/1918 | Gindele | 430/501 |
| 1,856,717 | 5/1932 | Mayer . | |
| 2,188,779 | 1/1940 | Roehrl | 95/9 |
| 3,022,170 | 2/1962 | Flinchbaugh et al. | 96/78 |
| 3,986,879 | 10/1976 | Klinkhammer | 96/78 |
| 4,276,371 | 6/1981 | Scott | 430/501 |
| 4,303,325 | 12/1981 | Seely | 354/212 |
| 4,930,712 | 6/1990 | Smart | 242/74 |
| 5,492,221 | 2/1996 | Light et al. | 206/813 |

*Primary Examiner*—A. A. Mathews
*Attorney, Agent, or Firm*—Mark G. Bocchetti

[57] ABSTRACT

A roll of photographic film where a film strip is coiled about a spool with a film leader attached to the film strip. The film leader includes a tongue portion, a tear line defining a tear-out region in the tongue portion, and an adhesive which is applied to the tear-out region. The tear-out region is bonded to an underlying convolution of the film leader when the film leader is wound on said roll. When a user lifts the film leader from the roll, the tear line is ruptured allowing the tear-out region to remain affixed to the underlying convolution of the film leader. This, in turn yields a hole in the film leader which can be used to attach the film loader to a take-up spool within a camera.

13 Claims, 1 Drawing Sheet

LIGHT SENSITIVE LEADER CLOSURE FOR ROLL FILM

FIELD OF THE INVENTION

This invention relates generally to photographic roll film and, more particularly, to methods for sealing closed the light shielding leader of a roll of photographic film.

BACKGROUND OF THE INVENTION

A variety of means for sealing closed the light shielding leader of a roll of photographic film are known in the prior art. These methods typically rely on a secondary substrate coated with an adhesive to maintain the seal. One example of this is taught in U.S. Pat. No. 3,022,170 to Flinchbaugh et al wherein a roll of photographic sheet material wound on a spool is retained in this condition by a temporary outer seal. The roll of photographic sheet material has affixed thereto an outer opaque paper leader wound up with the photosensitive strip. A window is formed in the leader by removing a portion thereof and a pressure-sensitive adhesive material is affixed to the leader such that it crosses the window. In such manner, the pressure-sensitive adhesive strip engages both the outermost convolution of the leader and the convolution immediately thereunder.

U.S. Pat. No. 2,188,779 to Roehrl teaches a self-sealing film roll which includes a strip of dry adhesive extending therefrom the paper backing strip located at the outer end of the roll of film. The paper backing strip is provided with a pair of apertures therethrough such that as the paper backing strip is coiled about the roll of film, the strip of adhesive crosses at least one of the apertures to thereby seal the roll.

U.S. Pat. No. 3,986,879 to Klinkhammer teaches yet another roll fastening system for film rolls. A roll of film is joined to a leader by means of a film sticker. A circular hole is punched into the leader in the vicinity of the film sticker thereby exposing a circular portion of the adhesive layer of the film sticker. An auxiliary hole is punched into the leader such that it will align with the hole punched in the vicinity of the film sticker during rolling on the next convolution. In such manner, the film sticker will bond through the circular hole and the auxiliary hole to a portion of the film leader after two convolutions.

Another common method for sealing a roll of photographic film is merely to wrap the film with a light sealing paper leader and then provide an adhesive strip wrapped about the paper leader. Still another method currently used to close the leader is an adhesive coated paper that circumferentially contains the leader. This is more commonly referred to as an outside paster. However, it is very difficult to remove the outside paster as it is snugly fit to the roll and offers no type of opening feature. Once the paster is removed, the photographer must cope with its disposal.

Thus, from the foregoing, it can be seen that the typical methods for sealing a roll of photographic film include three distinct elements, those being the roll of photographic film, the light sealing leader, and the adhesive strip. It would be economically advantageous and mechanically efficient if the sealing of a roll of photographic film could be accomplished with only two elements. In addition, it would be beneficial to obviate the disposal problem caused by leaders and outside pasters.

SUMMARY OF THE INVENTION

It is, therefore, an object of the present invention to provide a film leader which has incorporated therein a sealing means.

It is a further object of the present invention to provide a film leader and method for sealing rolls of film which remains permanently attached so that there is no generation of residual materials for disposal.

Still another object of the present invention is to provide a sealing means for a roll of photographic film wherein detachment of the sealing means generates an orifice which can be used in conjunction with the take-up spool as a positive locking device to ensure that the film is engaged by the take-up spool within the camera.

Briefly stated, these and numerous other features, objects and advantages of the present invention will become readily apparent upon a reading of the detailed description, claims and drawings set forth herein. These features, objects and advantages are accomplished by providing a roll of film with a leader which includes a die-cut perforated area containing an adhesive coating within the perforated area. The point of adhesion is intended to be permanent. In such manner, as the leader is coiled about the roll of film, the perforated area which is proximate to the end of the leader is pressed against an underlying convolution of a leader such that the adhesive bonds the perforated area of the leader permanently to the underlying convolution of leader. In order to open the roll of film, user need merely lift the tab end of the leader thereby breaking the perforations of the perforated area such that the die-cut perforated area will remain adhered to the underlying convolution of the backing paper. No separate piece is generated for disposal. In addition, a generally circular orifice is left in the tab end of the leader which can be used to affix the leader to the take-up spool within a camera.

DETAILED DESCRIPTION OF THE INVENTION

Figure 1:
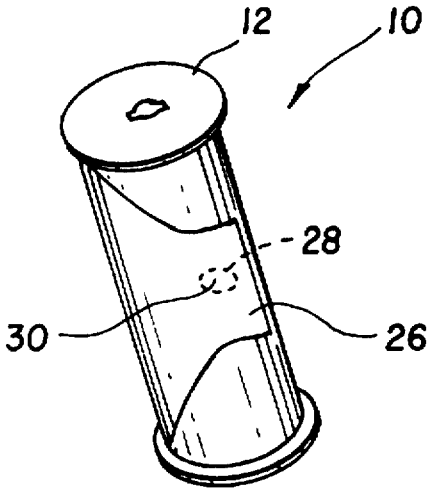
FIG. 1 is a perspective view of a roll of film including the closure device of the present invention.
Figure 2:
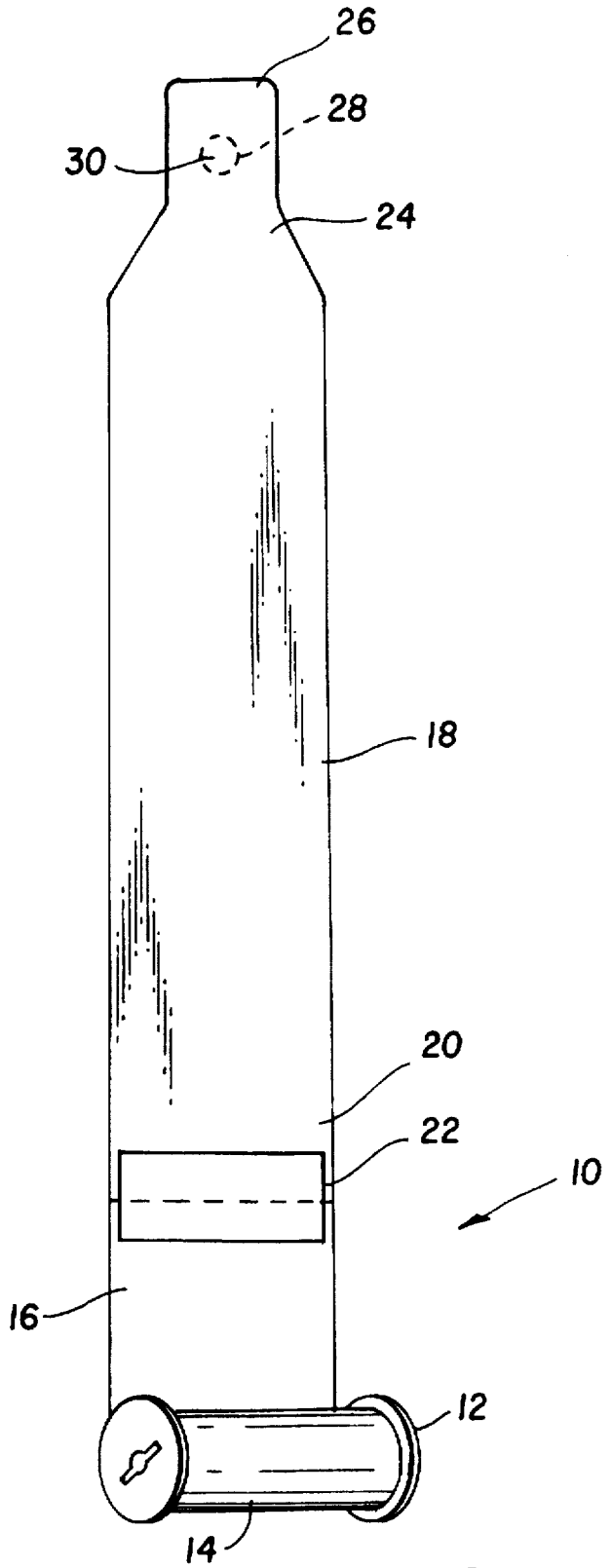
FIG. 2 is a perspective view of the roll film depicted in FIG. 1 partially unwound from the spool.

Turning first to FIG. 1, there is shown a roll 10 of photographic film tightly wound on a plastic spool 12. Typically, the roll 10 of photographic film includes a length of film strip 14 (see FIG. 2) coiled about core 12 with the lead end 16 of the film strip 14 butt spliced to the film leader 18. The film leader 18 may be made from paper or some other opaque materials to protect the film strip 14 from exposure to light. Butt splicing of the proximal end 20 of the film leader 18 to the lead end 16 may be made by means of adhesive tape 22 or other means well known in the art.

The distal end 24 of film leader 18 preferably includes a tongue portion 26 which is more narrow in width than film leader 18. Tongue portion 26 is provided with a perforated or die-cut tear line 28 creating a tear-out region 30. An adhesive is applied to the tear-out region 30. The adhesive chosen should be a permanent adhesive. An example of an adhesive which can be used is an acrylic based adhesive. Alternatively, the materials chosen for the film leader 18 and the film strip 14 may be joined by use of a cohesive. The use of the term "adhesive" herein is intended to include both adhesive and cohesive materials. Application of the adhesive may be by means of a rotogravure roll. Other methods for providing the tear out region 30 with an adhesive include double-sided tape. Alternatively, tear-out region 30 may be affixed to the underlying convolution by other means known in art such as, for example, thermal bonding or ultrasonic welding.

Once the adhesive has been applied to the tear-out region 30, winding of the film strip 14 and film leader 18 can be completed about spool 12. The length of leader 18 should be long enough to create at least 1.5 convolutions. With winding complete, the adhesive within tear-out region 30 is pressed against the underlying convolution of film leader 18 and bonded thereto. The area of adhesion is intended to be permanent. The specific adhesive chosen may be a heat activated adhesive such that application of heat will be needed to activate the adhesive and bond the tear out region 30 to the underlying convolution of film leader 18.

A user of the roll 10 of photographic film, in order to uncoil the roll 10, need merely grasp tongue portion 26 and lift. The lifting action will cause the tear-out region to separate from tongue portion 26 with tear-out region 30 remaining permanently affixed to the underlying convolution of film leader 18. No additional elements for disposal are generated. In addition, an orifice 32 is created in tongue portion 26 which can be used to promote attachment of film leader 18 to the take-up spool within a camera (not shown).

In some instances, rather than having a film leader 18 which is spliced to the film strip 14, the film is wound together with backing paper. The backing paper extends past the film at both ends to create a film leader. Typically, the film is attached to the backing paper by tape. The film leader portion of the backing paper would have incorporated therein the same feature described above with reference to roll 10. The present invention, as described above can be used equally as well with this type of film roll configuration.

From the foregoing, it will be seen that this invention is one well adapted to attain all of the ends and objects hereinabove set forth together with other advantages which are apparent and which are inherent to the invention.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

What is claimed is:

1. A roll of photographic film comprising:

(a) a film strip coiled about a spool;

(b) a film leader attached to said film strip, said film leader including a tongue portion;

(c) a tear line defining a tear-out region in said tongue portion; and (d) an adhesive applied to said tear-out region, said tear-out region being bonded to an underlying convolution of said film leader when said film leader is wound on said roll.

2. A roll of photographic film as recited in claim 1 wherein:

said tear-out region separates from said tongue portion and remains affixed to said underlying convolution when a user unseals said roll.

3. A film leader in combination with a photographic film strip wound in a roll, said film leader comprising:

(a) a light sealing portion attached to the photographic film strip;

(b) a tongue portion extending from said light sealing portion;

(c) a tear line defining a tear-out region in said tongue portion; and (d) an adhesive applied to said tear-out region, said tear-out region being bonded to an underlying convolution of said film leader when said film leader is wound on said roll.

4. A film leader as recited in claim 3 wherein:

said tear-out region separates from said tongue portion and remains affixed to said underlying convolution when said roll is unsealed.

5. A film leader as recited in claim 3 further comprising:

an orifice through said tongue portion generated by unsealing said roll.

6. A roll of photographic film as recited in claim 2 further comprising:

an orifice through said tongue portion generated by unsealing said roll.

7. A roll of photographic film comprising:

(a) a film strip coiled about a spool;

(b) a film leader attached to said film strip, said film leader including a tongue portion;

(c) a tear line defining a tear-out region in said tongue portion; and (d) means for affixing said tear-out region to an underlying convolution of said film leader when said film leader is wound on said roll.

8. A roll of photographic film as recited in claim 7 wherein:

said means for affixing is an adhesive.

9. A roll of photographic film as recited in claim 7 wherein:

said means for affixing is a pressure sensitive adhesive.

10. A roll of photographic film as recited in claim 7 wherein:

said means for affixing is a heat activated adhesive.

11. A roll of photographic film as recited in claim 7 wherein:

said means for affixing is a heat seal.

12. A roll of photographic film as recited in claim 7 wherein:

said means for affixing is an ultrasonic weld.

13. A roll of photographic film as recited in claim 7 further comprising:

an orifice through said tongue portion generated by unsealing said roll.

* * * * *